US009515370B2

(12) United States Patent
Rollins

(10) Patent No.: US 9,515,370 B2
(45) Date of Patent: Dec. 6, 2016

(54) ANTENNA ASSEMBLY AND METHODS OF ASSEMBLING SAME

(71) Applicant: The Aerospace Corporation, El Segundo, CA (US)

(72) Inventor: Gordon Z. Rollins, Woodland Hills, CA (US)

(73) Assignee: The Aerospace Corporation, El Segundo, CA (US)

( * ) Notice: Subject to any disclaimer, the term of this patent is extended or adjusted under 35 U.S.C. 154(b) by 350 days.

(21) Appl. No.: 13/677,501

(22) Filed: Nov. 15, 2012

(65) Prior Publication Data

US 2014/0132455 A1 May 15, 2014

(51) Int. Cl.
*H01Q 1/38* (2006.01)
*H01P 11/00* (2006.01)
*H01Q 15/08* (2006.01)

(52) U.S. Cl.
CPC ..... *H01P 11/00* (2013.01); *H01Q 15/08* (2013.01); *Y10T 29/49016* (2015.01)

(58) Field of Classification Search
CPC ..... H01Q 1/38
USPC ..... 343/700
See application file for complete search history.

(56) References Cited

U.S. PATENT DOCUMENTS 6,690,333 B2 2/2004 Eiges
6,982,676 B2 1/2006 Sievenpiper et al.
8,073,299 B2 12/2011 Taghizadeh et al.
2005/0030137 A1* 2/2005 McKinzie, III ..... H01Q 15/008 335/306
2009/0190231 A1 7/2009 Lenchenkov
2010/0060521 A1* 3/2010 Hayes ..... H01Q 1/38 342/368
2010/0202061 A1 8/2010 Black, Jr. et al.
2011/0317275 A1 12/2011 Smith et al.

FOREIGN PATENT DOCUMENTS

WO 2008044062 A1 4/2008

OTHER PUBLICATIONS

Young-Jin Park and Werner Wiesbeck, Fellow, IEEE, "Angular Independency of a Parallel-Plate Luneburg Lens With Hexagonal Lattice and Circular Metal Posts", IEEE Antennas and Wireless Propagation Letters, vol. 1, 2002, pp. 128-130.*

Young-Jin Park and Werner Wiesbeck, Fellow, IEEE, "Angular Independency of a Parallel-Plate Luneburg Lens With Hexagonal Lattice and Circular Metal Posts", IEEE Antennas and Wireless Propagation Letters, vol. 1,2002, pp. 128-130.*

Luneberg, R.K., "Mathematical Theory of Optics," 1964, pp. 182-188, University California Press, Berkeley, CA.

(Continued)

*Primary Examiner* — Sue A Purvis
*Assistant Examiner* — Andrea Lindgren Baltzell

(57) ABSTRACT

An antenna assembly is provided. The antenna assembly includes at least one foam member that is fabricated from a homogenous material, wherein the foam member includes a first surface and a second surface. At least one conductive plate including a first conductive plate is coupled to the foam member first surface. The foam member second surface is configured to couple to a second conductive plate or receive a conductive coating thereon to facilitate at least one electromagnetic wave to be channeled through the antenna assembly in a substantially single direction.

17 Claims, 5 Drawing Sheets

(56) References Cited

OTHER PUBLICATIONS

Fuchs, Benjamin et al., "Design Optimization of Multishell Luneberg Lenses," IEEE Transactions on Antennas and Propagation, Feb. 2007, pp. 283-289, vol. 55, No. 2.

Younis, Marwan et al., "A Parallel-Plate Luneberg Lens Sensor Concept for Automatic Cruise Control Applications," 31st European Microwave Conference, Sep. 24-26, 2001, pp. 1-4, London, England.

Pfeiffer, C., et al., "A Printed, Broadband Luneberg Lens Antenna," IEEE Transactions on Antennas and Propagation, Sep. 2010, pp. 3055-3059, vol. 58, No. 9.

Pfeiffer, C., et al., "A 2D broadband, printed Luneberg lens antenna," Antennas and Propagation Society International Symposium, 2009. APSURSI '09, IEEE, vol. No., pp. 1-4, Jun. 2009.

* cited by examiner

ANTENNA ASSEMBLY AND METHODS OF ASSEMBLING SAME

BACKGROUND

The field of the invention relates generally to communication systems and, more particularly, to antenna assemblies that may be used with such systems.

At least some known communication systems, such as, for example, radio broadcasting systems and satellite communications systems, use antennas to transmit and/or receive signals. At least some known antennas, such as high directivity antennas or beam antennas, can channel electromagnetic waves in at least one direction to facilitate increased performance while transmitting and/or receiving signals. Moreover, high directivity or beam antennas can substantially prevent interference from unwanted sources while transmitting and/or receiving signals. Due to significant losses for scanned beams, some high directivity antennas, such as reflector antennas, are limited to operations that are close to their boresight direction. In order to fill a large scan volume, the antenna may need to be physically rotated, which can be time-consuming and physically taxing.

Rather than using one antenna, a large physical area can be filled together with an array of many individual antenna elements. In order to eliminate grating lobes that substantially degrade directivity, the spacing between each of the individual antenna elements need to be kept to a fraction of a wavelength. As a result, several antenna elements are needed. However, using an array of antenna elements can be costly and the assembly may be complex. Moreover, the size and weight of the overall assembly may be substantially high.

BRIEF DESCRIPTION

In one embodiment, an antenna assembly is provided. The antenna assembly includes at least one foam member that is fabricated from a homogenous material, wherein the foam member includes a first surface and a second surface. At least one conductive plate including a first conductive plate is coupled to the foam member first surface. The foam member second surface is configured to couple to a second conductive plate or receive a conductive coating thereon to facilitate at least one electromagnetic wave to be channeled through the antenna assembly in a substantially single direction.

In another embodiment, a communication system is provided. The communication system includes an antenna assembly and a signal processing device that is coupled to the antenna assembly. The antenna assembly includes at least one foam member that is fabricated from a homogenous material, wherein the foam member includes a first surface and a second surface. At least one conductive plate including a first conductive plate is coupled to the foam member first surface. The foam member second surface is configured to couple to a second conductive plate or receive a conductive coating thereon to facilitate at least one electromagnetic wave to be channeled through the antenna assembly in a substantially single direction.

In yet another embodiment, a method of assembling an antenna assembly is provided. At least one foam member is fabricated from a homogenous material, wherein the foam member includes a first surface and a second surface. At least a first conductive plate is coupled to the foam member first surface and the foam member second surface is configured to couple to a second conductive plate or receive a conductive coating thereon to facilitate at least one electromagnetic wave to be channeled through the antenna assembly in a substantially single direction.

DETAILED DESCRIPTION

The exemplary systems and methods described herein overcome at least some known disadvantages associated with at least some known high directivity or beam antennas. The embodiments described herein provide an antenna assembly that includes at least one foam member that is fabricated from a homogenous material and at least one conductive plate that is coupled to the foam member to form a parallel plate Luneburg lens to facilitate electromagnetic wave(s) to be channeled through the antenna assembly in a substantially single direction. More specifically, the coupling of the foam member(s) with the plate(s) enable substantially narrow beam(s) of the electromagnetic wave(s) to be channeled in a substantially single direction. Accordingly, the exemplary antenna assembly provides a cost effective and convenient solution to fill a large scan volume, as several antenna elements are no longer needed. Moreover, using foam members and plates enables the antenna assembly to be relatively lightweight and have a relatively small size. As such, the antenna assembly can readily be moved and does not take up a great amount of space.

Figure 1:
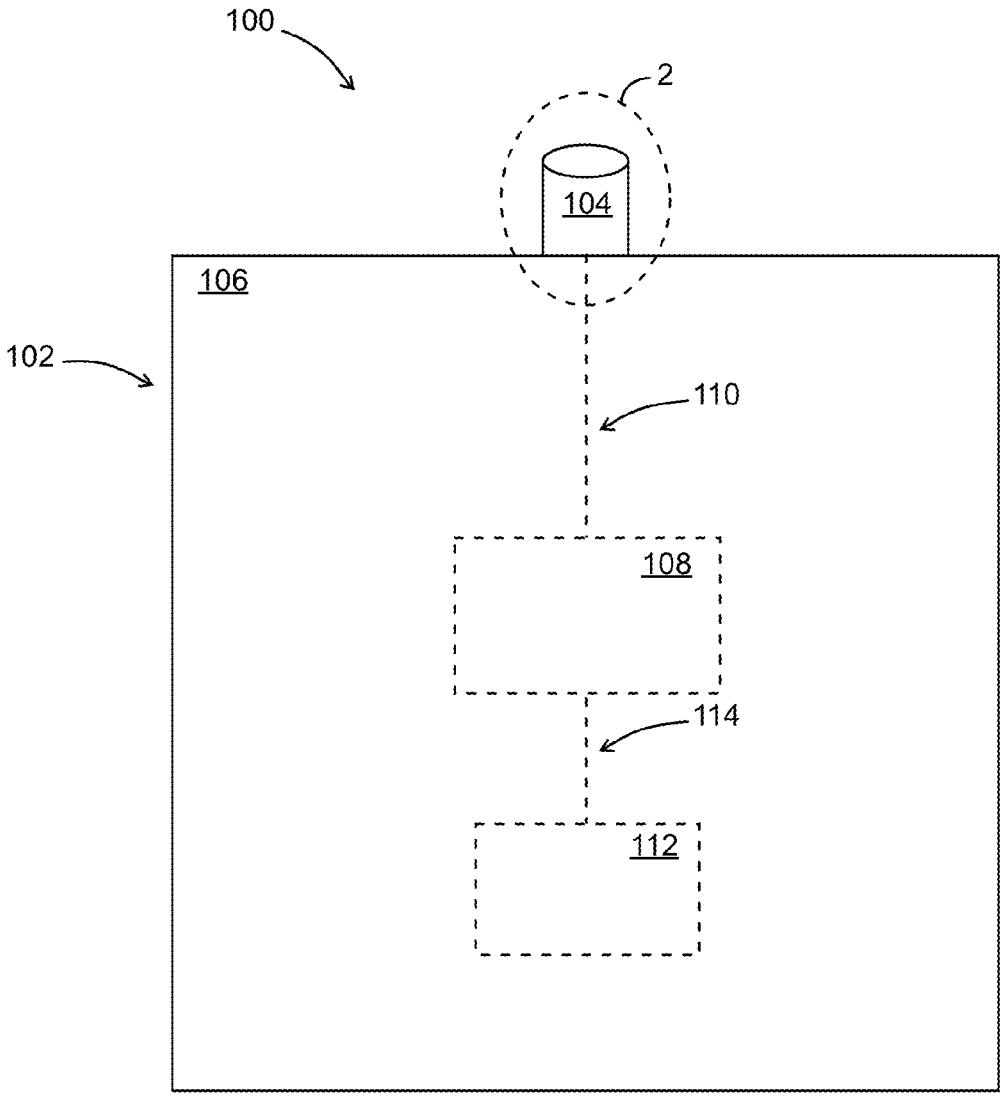
FIG. 1 is a block diagram of an exemplary communication system.

FIG. 1 illustrates a block diagram of an exemplary communication system 100. More specifically, communication system 100 is an antenna communication system, such as but not limited to radio broadcasting systems, satellite communications systems, broadcast television systems, two-way radio systems, radar systems, and cellular phone systems. While the exemplary embodiment illustrates an antenna communication system, the present invention is not limited to only being used with antenna communication systems and may be used in connection with other types of systems or devices.

In the exemplary embodiment, communication system 100 includes a structure 102 that is, for example, a home or a building. While the exemplary embodiment illustrates a home or a building, structure 102 may also be a mobile structure, such as a vehicle or vessel. For example, structure 102 may be a spacecraft that may be used for various purposes, such as but not limited to communications, planetary observation or exploration, and navigation.

Communication system 100 also includes at least one antenna assembly 104 that is coupled to structure 102. For example, antenna assembly 104 may be positioned on an exterior surface 106 of structure 102. While only one antenna assembly 104 is illustrated in FIG. 1, communication system 100 may have a plurality of antenna assemblies 104 coupled to surface 106 at various locations. In the exemplary embodiment, structure 102 also includes a signal processing device 108 that is coupled to antenna assembly 104 via a data conduit 110. Alternatively, signal processing device 108 may be wirelessly coupled to antenna assembly 104. It should be noted that, as used herein, the term "couple" is not limited to a direct mechanical and/or an electrical connection between components, but may also include an indirect mechanical and/or electrical connection between multiple components.

In the exemplary embodiment, antenna assembly 104 is configured to receive at least one signal from, for example, a satellite (not shown) and/or transducers (not shown) that are located external to structure 102. Signal processing device 108 is configured to process and/or analyze the signal(s) received by antenna assembly 104. As used herein, the term "process" refers to performing an operation on, adjusting, filtering, buffering, and/or altering at least one characteristic of a signal. For example, signal processing device 108 may be a computing device that includes a circuit (not shown) or a processor (not shown) such that signal processing device 108 can be configured to utilize either analog or digital signal processing techniques as well as using a hybrid mix of the two to generate an output that is representative of the signal received from antenna assembly 104. Alternatively, antenna assembly 104 may also be coupled to a signal generator (not shown) that is configured to generate at least one signal and antenna assembly 104 may be configured to transmit the generated signal(s) to, for example, a location that is external to structure 102.

A display device 112 is coupled to signal processing device 108 via a data conduit 114. In the exemplary embodiment, display device 112 is configured to display the output(s) generated by signal processing device 108 to a user. For example, display device 112 may be a visual display device, such as a cathode ray tube (CRT), a liquid crystal display (LCD), an light emitting diode (LED) display, an organic LED display, and/or an "electronic ink" display. Alternatively, display device 112 may be an audio output device that includes an audio adapter and/or a speaker.

During operation, in the exemplary embodiment, antenna assembly 104 receives at least one signal, such as radio signal(s), and the signal(s) are transmitted through assembly 104. The signal(s) are then transmitted to signal processing device 108 via conduit 110, wherein the signal processing device 108 processes and/or analyzes the signal(s) and an output is generated that can be displayed to a user via display device 112. As explained in more detail below, when the signal(s) are received by antenna assembly 104, relatively narrow beam(s) of electromagnetic wave(s) at varying or at specified frequencies are channeled through antenna assembly 104 in a substantially single direction. Moreover, as explained in more detail below, antenna assembly 104 and its components are relatively lightweight. As such, antenna assembly 104 may readily be moved to various locations on structure 102 and does not take up a great amount of space on structure 102.

Figure 2:
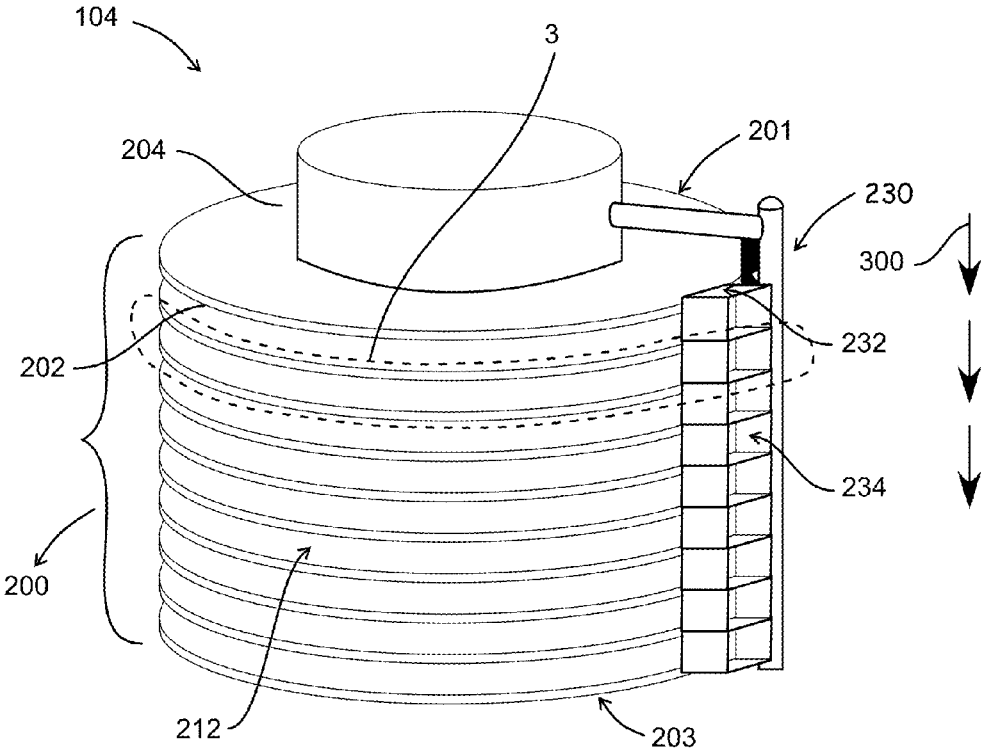
FIG. 2 is a perspective view of an exemplary antenna assembly that may be used with the communication system shown in FIG. 1 and taken from area 2.
Figure 3:
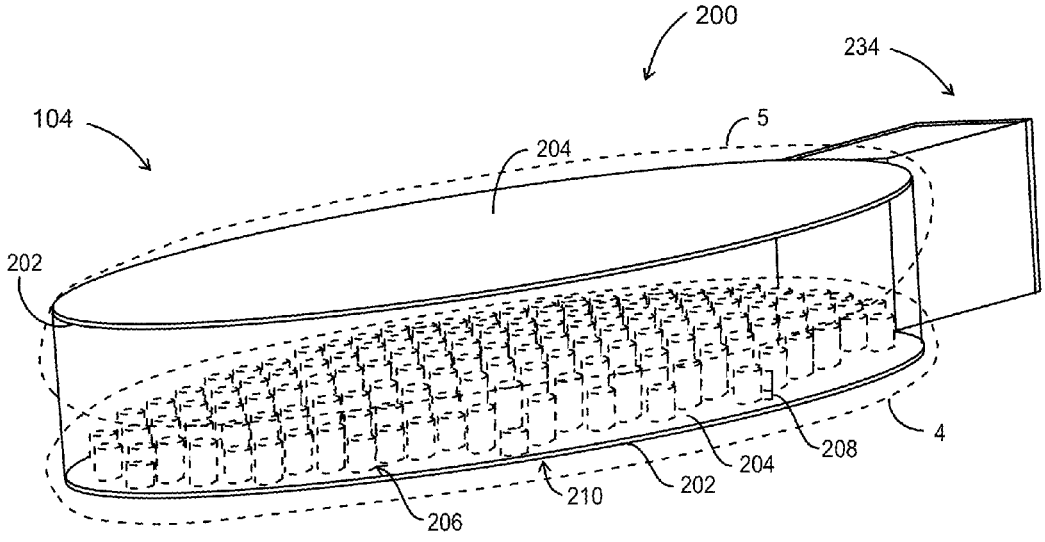
FIG. 3 is a perspective view of a portion of the antenna assembly shown in FIG. 2 and taken from area 3.
Figure 4:
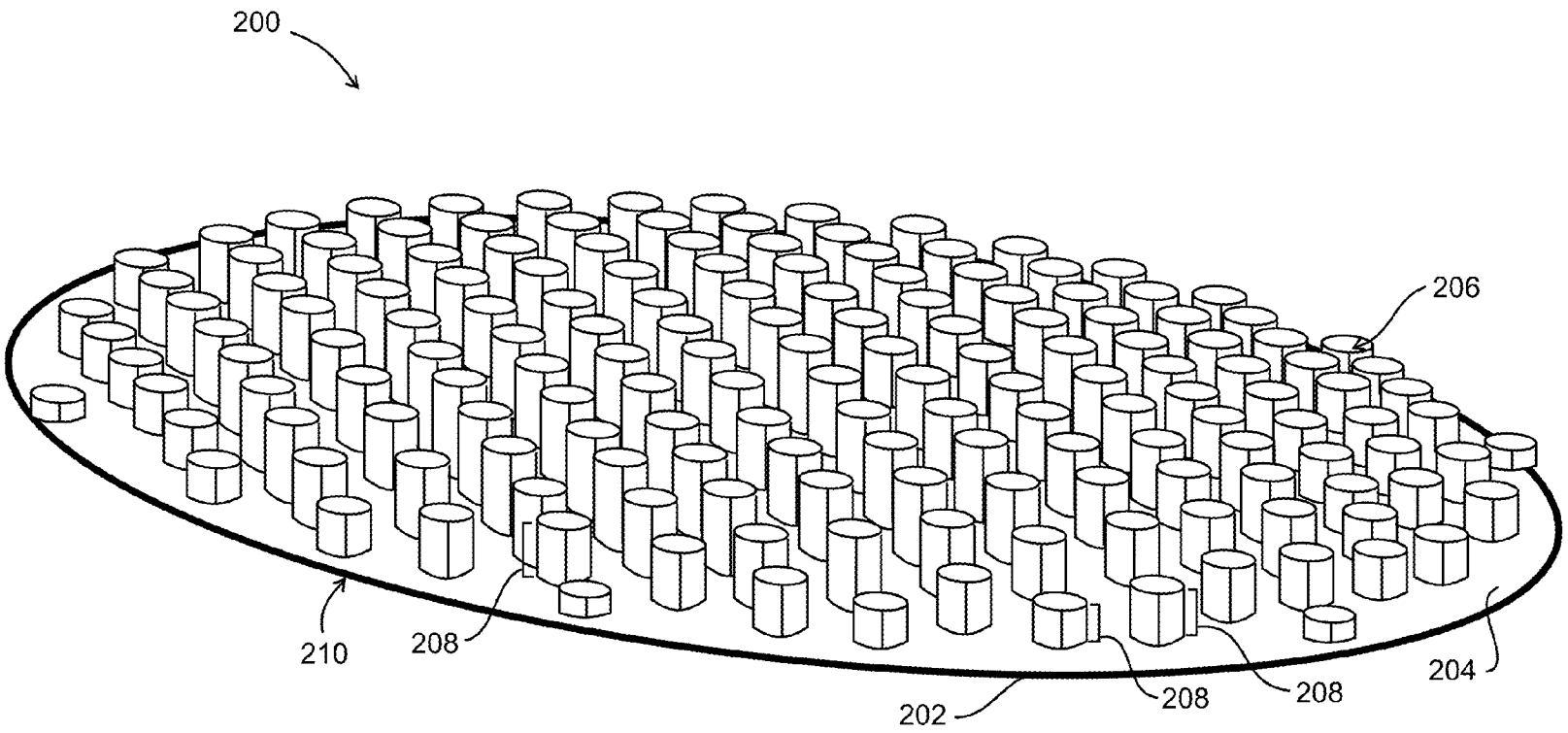
FIG. 4 is a perspective view of a portion of the antenna assembly shown in FIG. 3 and taken from area 4.
Figure 5:
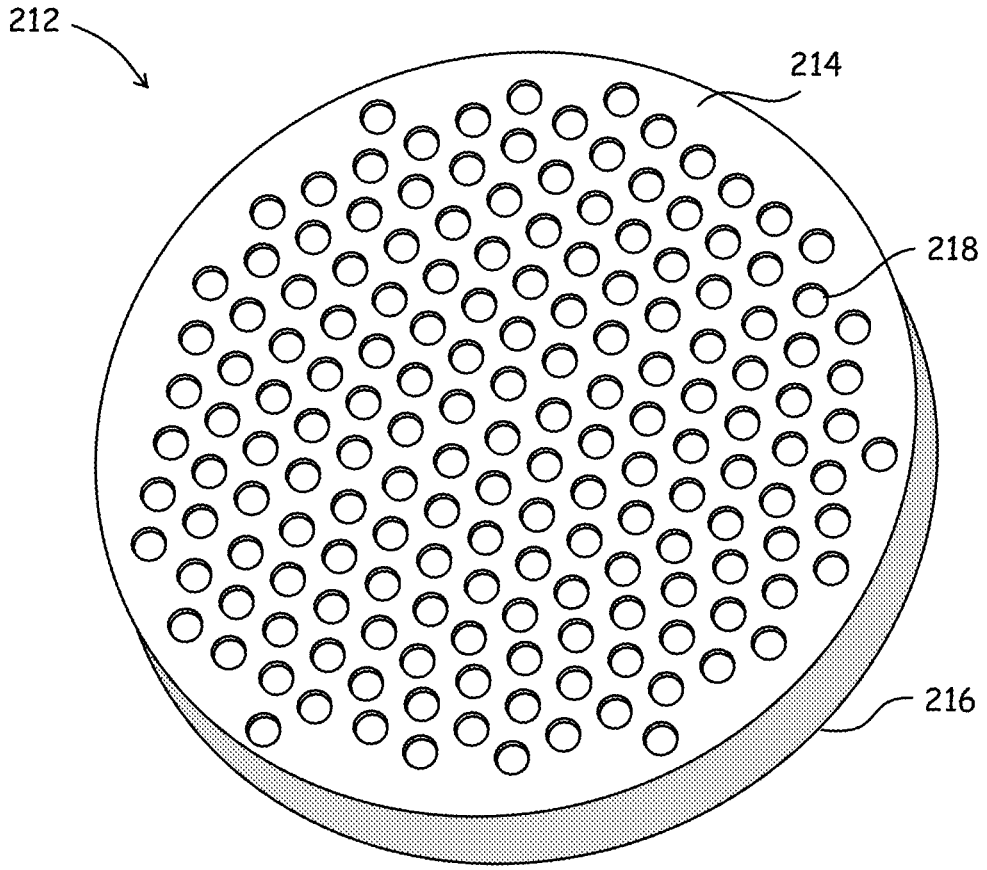
FIG. 5 is a top plan view of a portion of the antenna assembly shown in FIG. 3 and taken from area 5.

FIG. 2 is a perspective view of antenna assembly 104 taken from area 2 (shown in FIG. 1). FIG. 3 is a perspective view of a portion of antenna assembly 104 taken from area 3 (shown in FIG. 2). FIG. 4 is a perspective view of antenna assembly 104 taken from area 4 (shown in FIG. 3). FIG. 5 is a top plan view of a portion of antenna assembly 104 taken from area 5 (shown in FIG. 3). In the exemplary embodiment, antenna assembly 104 includes a plurality of conductive plates 200 that include a first or top plate 201 and a tenth or bottom plate 203. Alternatively, antenna assembly 104 may include any number of plates 200 that enable antenna assembly 104 and/or communication system 100 (shown in FIG. 1) to function as described herein. In the exemplary embodiment, each plate 200 is substantially circular and each of the plates 200 are substantially similar in size by having, for example, substantially proportional diameters and mass. Alternatively, plates 200 may be any size and shape that enables antenna assembly 104 and/or communication system 100 to function as described herein. Further, in the exemplary embodiment, each plate 200 is fabricated from lightweight conductive materials such as, for example, carbon fiber.

Each plate 200 has a first surface 202 and a second surface 204, wherein each surface 202 and 204 is substantially planar. In the exemplary embodiment, some plates 200 may include a plurality of conductive posts 206 that extend from second surface 204. More specifically, in the exemplary embodiment, each post 206 is integrally formed with plate surface 204. Moreover, each post 206 extends a predefined distance 208 outwardly from plate second surface 204 such that each post 206 is substantially perpendicular with respect to plate second surface 204. In the exemplary embodiment, predefined distance 208 varies for each post 206. More specifically, the height of each post 206 varies such that some posts 206 may have substantially similar or different heights. For example, one post 206 may have a height that is substantially similar to at least one other post 206. Alternatively, one post 206 may have a height that is substantially different from at least one other post 206. Moreover, as illustrated in the exemplary embodiment, posts 206 that are positioned directly adjacent to an outer edge 210 of plate 200 may have a relatively lower height than some of the posts 206 that are positioned at a center (not shown) of plate 200.

In the exemplary embodiment, a plurality of foam members 212 are coupled to plates 200. More specifically, in the exemplary embodiment, nine foam members 212 are coupled to the ten plates 200. Alternatively, antenna assembly 104 may have any number of foam members 212 that enable antenna assembly 104 and/or communication system 100 to function as described herein. In the exemplary embodiment, each foam member 212 is substantially circular and foam members 212 are substantially similar in size by having, for example, substantially proportional diameters and mass. Alternatively, foam members 212 may be any size and shape that enables antenna assembly 104 and/or communication system 100 to function as described herein. Moreover, each foam member 212 is substantially identical to each plate 200. For example, the diameter of each foam member 212 is substantially proportional to the diameter of each plate 200. In the exemplary embodiment, each foam member 212 is manufactured from a lightweight homogenous material that has a relatively low dielectric constant in the range of between about 1.0 to 2.0, and, more preferably, in the range of between about 1.0 to 1.05. For example, each foam member 212 may be manufactured from a polymethacrylimide material, such as ROHACELL®. ROHACELL® is a registered trademark of Evonik Industries of Essen, Germany. Alternatively, foam member 212 may be manufactured from any suitable material that enables antenna assembly 104 and/or communication system 100 to function as described herein.

In the exemplary embodiment, each foam member 212 has a first surface 214 and a second surface 216. In the exemplary embodiment, first surface 214 includes a plurality of openings 218 that are sized and shaped to receive the posts 206 therein and second surface 216 is substantially planar. In the exemplary embodiment, foam members 212 are coupled to plates 200 such that each are stacked on top of one another wherein one foam member 212 is positioned between two plates 200. More specifically, second surface 204 of one plate 200 is positioned adjacent first surface 214 of one foam member 212 such that the posts 206 are coupled within openings 218 and first surface 202 of another plate 200 is positioned adjacent second surface 216 of the foam member 212. In the exemplary embodiment, posts 206 are securely positioned within openings 218 such that portions of the foam member 212 that define each opening 218 substantially circumscribe the post 206 contained within each opening 218.

In the exemplary embodiment, foam members 212 and plates 200 are each substantially parallel with respect to each other and are stacked on top of one another to substantially form a cylinder. More specifically, foam members 212 and plates 200 form a parallel plate Luneburg lens. While the exemplary embodiment illustrates a plurality of plates 200 and a plurality of foam members 212, antenna assembly 104 may only include one plate 200 and one foam member 212. For example, first surface 214 of foam member 212 may be positioned adjacent to second surface 204 of one plate 200 such that the posts 206 of the plate 200 are coupled within openings 218. Moreover, second surface 216 of the foam member 212 may be configured to receive a conductive coating (not shown) thereon as opposed to another plate 200. The conductive coating may be any suitable conductive coating, such as an aluminum and/or tin coating. The conductive coating may be applied onto foam member 212 via any method known in the art, such as by spraying the conductive coating on second surface 216.

Antenna assembly 104 also includes a feed apparatus 230 such that at least one receiving element (not shown), such as an antenna and/or a receiver (not shown), may be positioned therein. More specifically, in the exemplary embodiment, apparatus 230 includes at least one column 232 of a plurality of feed elements 234 that are stacked on top of one another. In the exemplary embodiment, feed elements 234 are configured to house the receiver and/or the antenna therein such that elements 234 may be enabled to resonate at a certain frequency or set of frequencies. In the exemplary embodiment, feed apparatus 230 includes one column 232 to enable a single beam at a specific frequency to be channeled through antenna assembly 104. Alternatively, feed apparatus 230 may include any number of columns 232 that include any number of feed elements 234 that enable antenna assembly 104 and/or communication system 100 to function as described herein. For example, assembly 104 may include two columns 232 that each include a plurality of elements 234 to facilitate, for example, automated azimuth tracking. Moreover, feed apparatus 230 may include multiple columns 232 that each include a plurality elements 234 to enable multiple beams at varying frequencies or at a specified frequency to be channeled simultaneously through assembly 104.

During operation, antenna assembly 104 receives at least one signal, such as a radio signal (i.e., electromagnetic wave). The signal(s) are transmitted to feed apparatus 230 through at least one element 234 and the electromagnetic wave(s) are channeled through assembly 104 at varying frequencies or at a specified frequency. More specifically, the electromagnetic wave(s) are channeled through the posts 206 within assembly 104, as shown by arrows 300. When the electromagnetic waves are being channeled through posts 206, foam member 212 substantially prevents the waves from dispersing from within the confines of the area of the posts 206. More specifically, the portions of foam member 212 that substantially circumscribe the posts 206 absorb portions of the waves that are dispersed from the posts 206. The electromagnetic wave(s) are then enabled to take on the shape of the posts such that substantially narrow beam(s) of the electromagnetic wave(s) may be channeled through antenna assembly 104 in a substantially single direction. As such, antenna assembly 104 is enabled to facilitate high directivity beams for the electromagnetic waves without having to use an array of many individual antenna elements.

As compared to known antennas, the above-described antenna assembly provides high directivity beams for the electromagnetic waves without having to use an array of many individual antenna elements. The antenna assembly includes at least one foam member that is fabricated from a homogenous material, wherein the foam member includes a first surface and a second surface. At least one conductive plate including a first conductive plate is coupled to the foam member first surface. The foam member second surface is configured to couple to a second conductive plate or receive a conductive coating thereon to facilitate at least one electromagnetic wave to be channeled through the antenna assembly in a substantially single direction. More specifically, the coupling of the foam member with the conductive plate enables substantially narrow beam(s) of the electromagnetic wave(s) to be channeled though the assembly. Accordingly, the exemplary antenna assembly provides a cost effective and convenient solution to fill a large scan volume, as several antenna elements are no longer needed. Moreover, using foam members and plates enables the antenna assembly to be relatively lightweight and have a relatively small size. As such, the antenna assembly can readily be moved and does not take up a great amount of space.

Exemplary embodiments of the systems and methods are described above in detail. The systems, and methods are not limited to the specific embodiments described herein, but rather, components of the systems and/or steps of the method may be utilized independently and separately from other components and/or steps described herein. For example, the system may also be used in combination with other systems and methods, and is not limited to practice with only a communication system as described herein. Rather, the exemplary embodiment can be implemented and utilized in connection with many other systems.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An antenna assembly comprising:

at least one foam member that is fabricated from a homogenous material, wherein said at least one foam member comprises a first surface and a second surface; and at least one conductive plate comprising a first conductive plate that is coupled to said foam member first surface and said foam member second surface is configured to receive a conductive coating thereon to facilitate at least one electromagnetic wave to be channeled through said antenna assembly in a substantially single direction, wherein said at least one conductive plate comprises a first surface, a second surface, and a plurality of conductive posts that are each integrally formed with said plate second surface such that each of said plurality of conductive posts extends a predefined distance outwardly from said plate second surface, and wherein said first conductive plate has a mass and a diameter that are each substantially proportional to a second mass and a second diameter, respectively, of at least one other conductive plate.

2. An antenna assembly in accordance with claim 1, wherein one of said plurality of conductive posts extends a predefined distance that is different than a predefined distance of at least one other conductive post of said plurality of conductive posts.

3. An antenna assembly in accordance with claim 1, wherein said foam member first surface comprises a plurality of openings configured to receive said plurality of conductive posts therein.

4. An antenna assembly in accordance with claim 1, wherein said at least one foam member comprises a first foam member, a second foam member, a third foam member, and a fourth foam member.

5. An antenna assembly in accordance with claim 4, wherein said first conductive plate is coupled to said first foam member, a second conductive plate is coupled between said first foam member and said second foam member, a third conductive plate is coupled between said second foam member and said third foam member, and a fourth conductive plate is coupled between said third foam member and said fourth foam member.

6. An antenna assembly in accordance with claim 5, wherein each of said first, second, third, and fourth conductive plates are arranged substantially parallel with respect to each other such that said antenna assembly forms a parallel plate Luneburg lens.

7. An antenna assembly in accordance with claim 1, wherein said at least one foam member and said at least one conductive plate are each substantially circular.

8. An antenna assembly in accordance with claim 7, wherein said at least one foam member comprises a diameter that is substantially proportional to a diameter of said at least one conductive plate.

9. A communication system comprising:

an antenna assembly comprising:

at least one foam member that is fabricated from a homogenous material, wherein said at least one foam member comprises a first surface and a second surface; and at least one conductive plate comprising a first conductive plate that is coupled to said foam member first surface and said foam member second surface is configured to receive a coating thereon to facilitate at least one electromagnetic wave to be channeled through said antenna assembly in a substantially single direction, wherein said at least one conductive plate comprises a first surface, a second surface, and a plurality of conductive posts that are each integrally formed with said plate second surface such that each of said plurality of conductive posts extends a predefined distance outwardly from said plate second surface, and wherein said first conductive plate has a mass and a diameter that are each substantially proportional to a second mass and a second diameter, respectively, of at least one other conductive plate; and a signal processing device coupled to said antenna assembly.

10. A communication system in accordance with claim 9, wherein one of said plurality of conductive posts extends a predefined distance that is different than a predefined distance of at least one other conductive post of said plurality of conductive posts.

11. A communication system in accordance with claim 9, wherein said foam member first surface comprises a plurality of openings configured to receive said plurality of conductive posts therein.

12. A communication system in accordance with claim 9, wherein said at least one foam member comprises a first foam member, a second foam member, a third foam member, and a fourth foam member.

13. A communication system in accordance with claim 12, wherein said first conductive plate is coupled to said first foam member, a second conductive plate is coupled to said first foam member and to said second foam member, a third conductive plate is coupled to said third foam member, and a fourth conductive plate is coupled to said fourth foam member, each of said first, second, third, and fourth conductive plates are arranged substantially parallel with respect to each other such that said antenna assembly forms a parallel plate Luneburg lens.

14. A method of assembling an antenna assembly, said method comprising:

fabricating at least one foam member from a homogenous material, wherein the at least one foam member includes a first surface and a second surface; and coupling at least a first conductive plate to the foam member first surface, and the foam member second surface is configured to receive a conductive coating thereon to facilitate at least one electromagnetic wave to be channeled through the antenna assembly in a substantially single direction, wherein the first conductive plate includes a first surface, a second surface, and a plurality of conductive posts that are each integrally formed with the first conductive plate second surface such that each of the plurality of conductive posts extends a predefined distance outwardly from the first plate second surface, and wherein the first conductive plate has a mass and a diameter that are each substantially proportional to a second mass and a second diameter, respectively, of at least one other conductive plate.

15. A method in accordance with claim 14, wherein coupling at least a first conductive plate to the foam member further comprises coupling the plurality of posts to a plurality of openings on the foam member first surface.

16. A method in accordance with claim 14, wherein fabricating at least one foam member further comprises fabricating a first foam member, a second foam member, a third foam member, and a fourth foam member.

17. A method in accordance with claim 16, coupling at least a first conductive plate further comprises:

coupling the first conductive plate to the first foam member;

coupling a second conductive plate between the first foam member and the second foam member;

coupling a third conductive plate between the second foam member and the third foam member; and coupling a fourth conductive plate between the third foam member and the fourth foam member, wherein each of the first, second, third, and fourth conductive plates are arranged substantially parallel with respect to each other such that the antenna assembly forms a parallel plate Luneburg lens.

* * * * *